United States Patent [19]

Lafferty

[11] 4,282,824

[45] Aug. 11, 1981

[54] MEMORY AIDING DEVICE

[76] Inventor: Lyndon E. Lafferty, 230 Bergwall Way, Vallejo, Calif. 94590

[21] Appl. No.: 955,329

[22] Filed: Oct. 27, 1978

[51] Int. Cl.[3] ..... G09F 9/00

[52] U.S. Cl. ..... 116/308; 40/19.5; 40/110; 40/622; 116/325

[58] Field of Search ..... 40/107, 110, 618; 273/282; 116/325; 35/24 A, 24 R

[56] References Cited

U.S. PATENT DOCUMENTS

| | | | |
|---|---|---|---|
| 1,481,467 | 1/1924 | Hockin | 40/618 X |
| 2,305,370 | 12/1942 | Wissing | 40/110 |
| 2,509,659 | 5/1950 | Wassell | 116/325 |
| 2,624,227 | 1/1953 | Smith | 116/325 |
| 3,579,884 | 5/1971 | Bray | 40/110 |
| 3,929,337 | 12/1975 | Hayes | 273/282 |
| 4,148,273 | 4/1979 | Hollingsworth et al. | 116/325 |

FOREIGN PATENT DOCUMENTS

| | | | |
|---|---|---|---|
| 789898 | 1/1955 | United Kingdom | 116/325 |

*Primary Examiner*—Gene Mancene
*Assistant Examiner*—Wenceslao J. Contreras
*Attorney, Agent, or Firm*—Bielen and Peterson

[57] ABSTRACT

A device for aiding the remembering of an event which uses a display having board having a surface visible to the observer. A plurality of openings are adapted for accepting a peg like element having a plurality of faces. Indicia associated with each opening denotes a selected time period.

5 Claims, 7 Drawing Figures

MEMORY AIDING DEVICE

BACKGROUND OF THE INVENTION

The present invention relates to a device for aiding memory of an individual usually to perform a certain act at a certain time.

Memory aids mnemonics have been used to designate a certain time period in the future during which a person must carry out a certain mental or physical step or action. The standard calendar has been employed for this purpose by circling or otherwise marking a particular day thereon as an indication of an event in the future. The marking of a future event takes on added importance when the act to be performed involves a medical or hygienic need such as the taking of a pill, the washing of a wound, the brushing of teeth, and the like.

Recent mnemonic devices have included the birth control pill calendar which fixes a pill adjacent a day of the week on a circular card. After the user takes the pill she is reminded of the same in the future and may act accordingly in regulating this systematic ingestion. A device for aiding in the remembering to perform a certain act at a future time period which may be freely employed for any event is needed.

SUMMARY OF THE INVENTION

In accordance with the present invention a novel and useful memory aiding device is provided.

A device of the present invention utilizes a display board having at least one surface adapted for visible display toward an observer. The plurality of openings are associated with indicia each of which denote a selected time period. The plurality of openings may include a plurality of substantially parallel rows. In addition, at least two of the plurality of rows of the plurality of openings may be staggered or offset from each other. This is particularly useful to obviate confusion between different sets of time periods ie: days, weeks, and the like.

Further, the device of the present invention may include a plurality of surfaces, each surface having a plurality of openings. Three of said surfaces may be orthogonally oriented with respect to one another. Each of the separate surfaces may be employed to designate interacting time periods such as hours, days, and weeks.

The device also has peg means sized for fitting within any of said plurality of openings. Such peg means may include an appendage, which is sized to fit within any of said openings, and an enlarged portion. The enlarged portion further externalizes in a plurality or multiplicity of faces, each face of which would indicate a sequence eg: one, two, three, four, etc. For convenience the memory aiding device of the present invention may be mounted on a wall next to the place where a medication is stored. Also, the device of the present invention may include means for storing the particular medication.

It may be seen that a unique and useful memory aiding device is provided.

It is therefore an object of the present invention to provide a memory aiding device which is simple and easy to use and conveniently serves as a reminder to perform a future act.

It is another object of the present invention to provide a memory aiding device which requires a minimum of manual dexterity.

It is yet another object of the present invention to provide a memory aiding device which aids persons who are under medication.

It is yet another object of the present invention to provide a memory aiding device for the elderly.

Another object of the present invention is to provide a memory aiding device which is compact and may be easily portable.

Yet another object of the present invention is to provide a memory aiding device which is capable of keeping track of multiple medications within the same time period.

The invention possesses other objects and advantages especially as concerns particular features thereof and characteristics thereof, which will become apparent as the specification continues.

For a better understanding of the invention, references made to the following detailed description.

DESCRIPTION OF THE PREFERRED EMBODIMENTS

Various aspects of the present invention will evolve from the following detailed description of the preferred embodiments thereof, which should be taken in conjunction with the heretofore described drawings.

Figure 1:
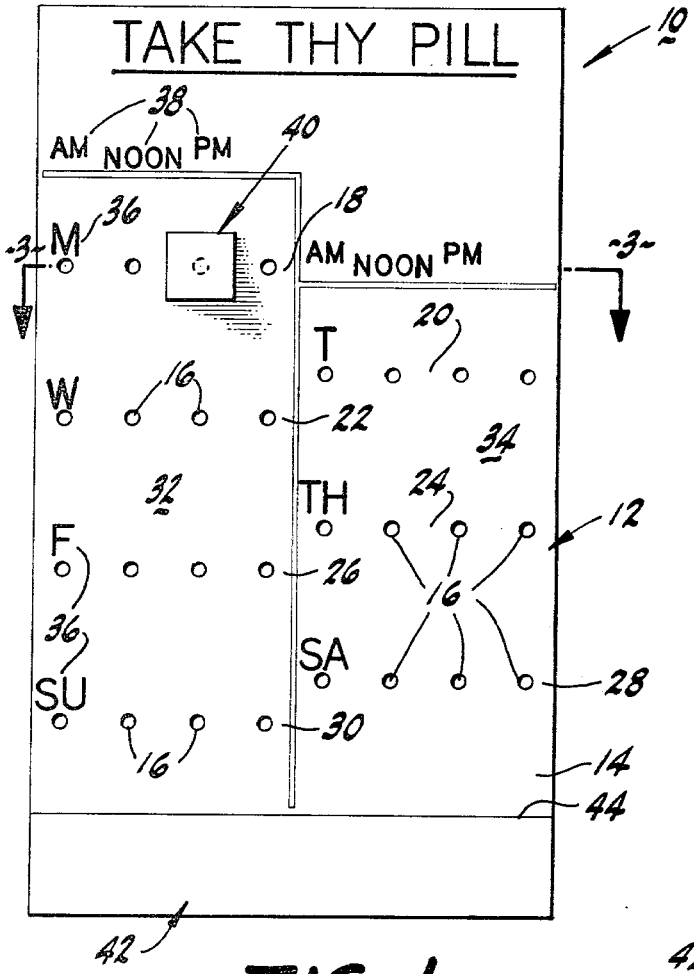
FIG. 1 is a front elevational view of an embodiment of the present invention.

With reference to the drawings, the invention as a whole is depicted by reference character 10 and includes as one of its elements a display board 12, FIG. 1, may be constructed of any solid material such as wood, plastic, metal, and the like. Likewise the display board 12 may be formed into any shape but is shown in the drawings as taking the shape of a rectangular solid. Display board 12 includes at least one surface 14 which is visible to an observer or user of the device. On surface 14 are a plurality of openings 16 arranged in a plurality of rows 18, 20, 22, 24, 26, 28, and 30. The aforesaid rows 18, 20, 22, 24, 26, 28, and 30 of the plurality of opening 16 are divided into group of rows 32 and group of rows 34. Group 32 is shown side by side group 34. Pair of rows 18 and 20 are staggered from each other. Likewise, all the rows of the plurality of opening 16 and group 32 are staggered from those in group 34.

Adjacent each particular opening of said plurality of said opening 16 is found an indicium denoting a selected time period. For example, row 18 is associated with the indicium 36 and the indicia 38. Thus, opening 40 would mean that an event was to take place during Monday morning.

Figure 2:
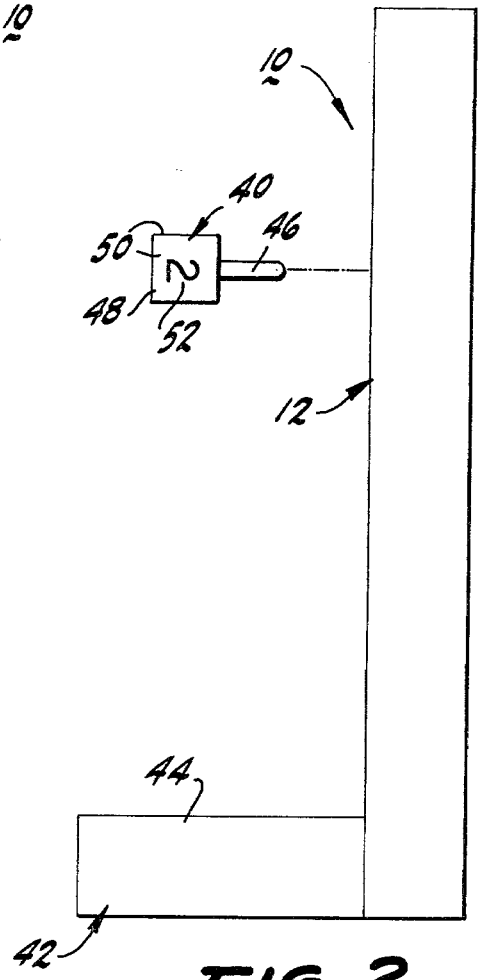
FIG. 2 is a side elevational view of an embodiment of the present invention.
Figure 3:
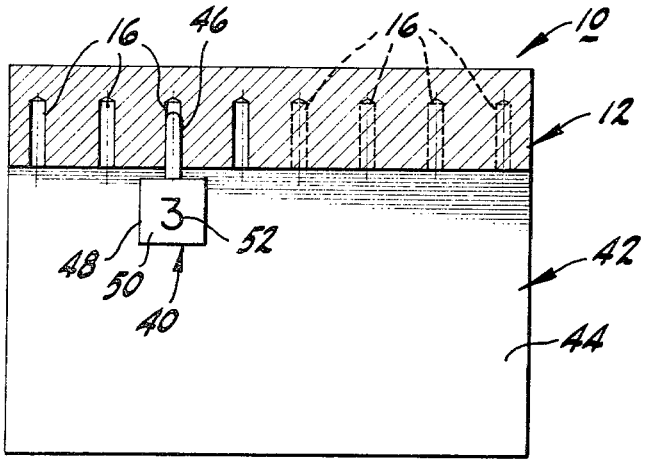
FIG. 3 is a view taken along line 3—3 of FIG. 1.

Peg means 40 is adapted for fitting within any of said plurality of opening 16 such that peg means 40 is supported by the same. It should be noted that row 20 is sequential with row 18. That is, the embodiment shown in FIGS. 1 through 3, row 20 is associated with the day Tuesday of any particular week. Therefore peg means 40 moved to the end of Monday would then begin row 20 (Tuesday) by dropping down along surface 14 of display board 12. It may be surmised that this prevents confusion as to the intended and true position of peg means 40.

Display board 12 may include a shelf 42 having an upper surface 44 which may be used to support a medication container (not shown).

Figure 4:
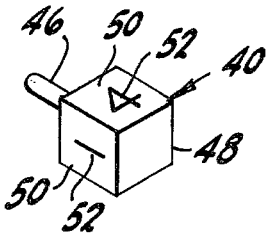
FIG. 4 is a perspective view of multifaceted peg means.

Peg means 40 may take the form of a member having an appendage 46 and an enlarged portion 48, best shown in FIG. 4. Appendage 46 is adapted for fitting in any of the plurality of openings 16. Thus, enlarged portion 48 would be suspended on surface 14 at a particular place by the mating of appendage 46 and any one of the plurality of openings 16. It should be noted that enlarged portion 48 of peg means 40 may include a plurality of surfaces 50. Each of the plurality of surfaces 50 include an indicium of a selected sequence. For example, FIG. 1–FIG. 4 show the indicium 52 denoting the numerical sequence 1 through 4. It should be noted, however, that other sequences such as alphabetical a, b, c, etc., and the like may be shown on the plurality of surfaces 50.

Figure 5:
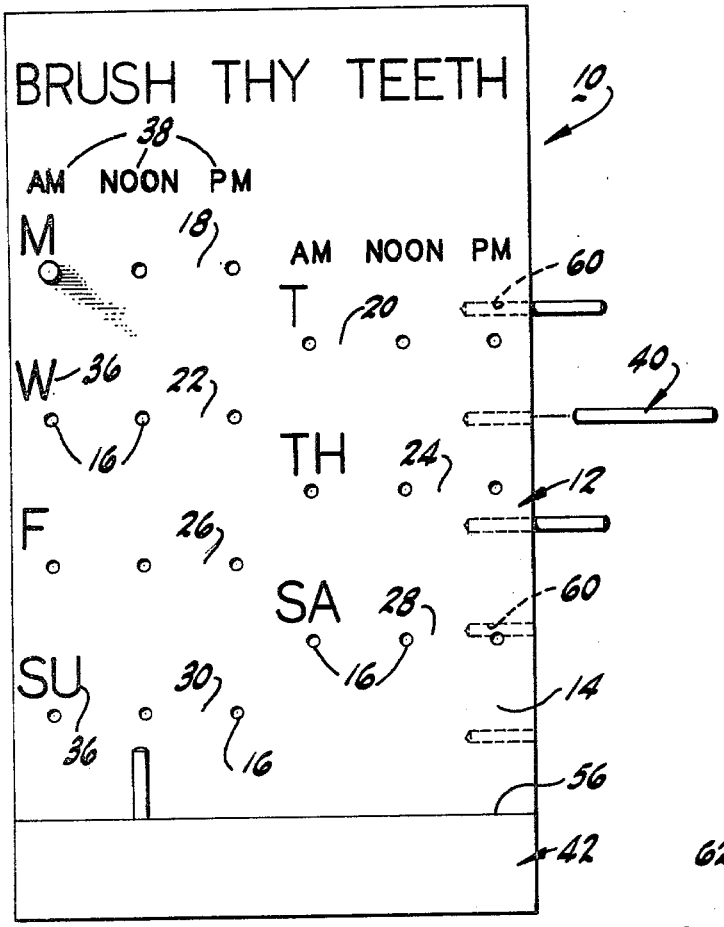
FIG. 5 is a front elevational view of an embodiment of the invention.
Figure 6:
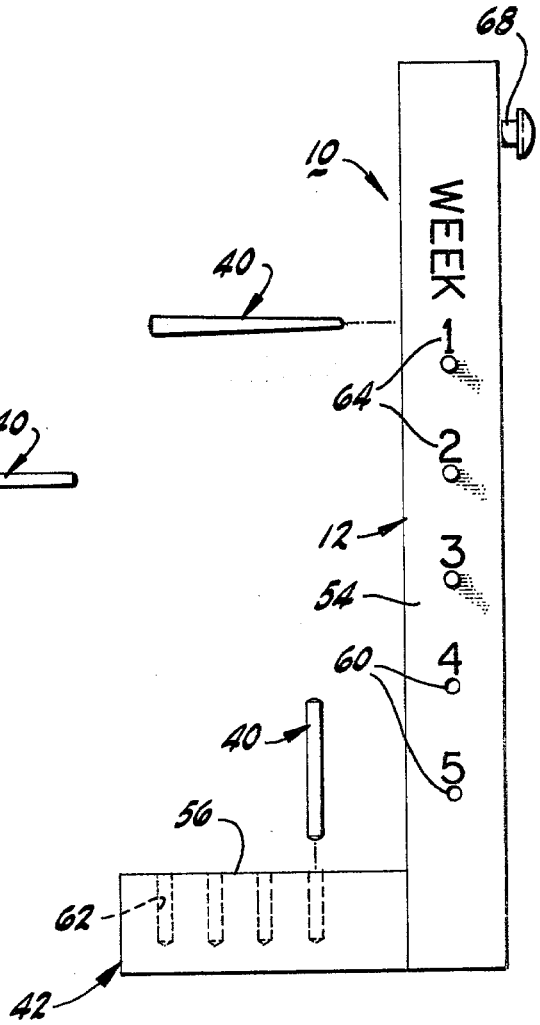
FIG. 6 is a side elevational view of another embodiment of the invention.
Figure 7:
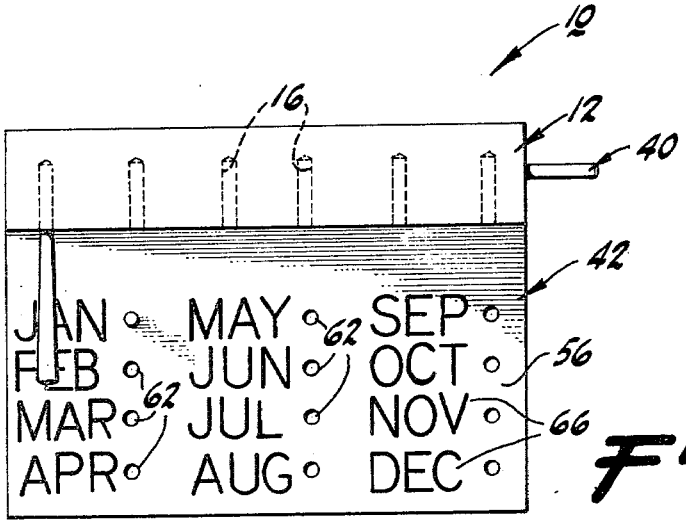
FIG. 7 is a top plan view of another embodiment of the invention.

Turning to FIGS. 5 through 7, it may be seen that device 10 may take another embodiment where additional surfaces 54 and 56 are shown for the purposes of this disclosure the reference characters employed in FIGS. 1 through 4 of the first embodiment are again employed for comparable elements shown in FIGS. 5 through 7. Surfaces 14, 54, and 56 are depicted as being separated by 90°, ie: surfaces 14, 54, and 56 are orthogonally oriented with respect to one another. Peg means 40 is depicted in the form of a roughly cylindrical and slightly tapered member 58. Surface 54 and surface 56 include plurality of openings 60 and 62 respectively. Again, plurality of openings 60 and 62 are adapted for fitting peg means 40 therewithin. Indicia 64 and 66 on surfaces 54 and 56 may be employed to denote related time periods to those found on surface 14 of display board 12. Mounting means 68 may be employed to hang device 10 on a vertical surface.

In operation the user consults position of peg means 40 on surface 14, 54, and/or 56 to determine whether an act is to be performed such as taking a medication. The user then performs the act and moves peg means 40 to the next opening on the particular surface in order to flag the subsequent act to be performed. FIGS. 1 through 4 depict an embodiment used to mark the taking of a pill. Likewise, FIGS. 5 through 7 illustrate the brushing of teeth. It should be noted, that FIGS. 5 through 7 span a time period of one year with the particular week appearing on surface 54, the particular month appearing on surface 56, and the particular day appearing on surface 14. It should be apparent that the embodiment shown in FIG. 5–FIG. 7 may be used to record the brushing of teeth as well as to remind a user to brush his or her teeth.

While in the foregoing embodiments of the present invention have been set forth in considerable detail for the purposes of making a complete disclosure thereof, it will be apparent to those of ordinary skill in the art that numerous changes may be made in such details without departing from the spirit and principles of the invention.

What is claimed is:

1. A device for aiding memory in the performance of an act such as the administration of a medication comprising:

a. a display board including a plurality of surfaces, including a first surface having at least a pair of substantially parallel rows of a plurality of openings being staggered from each other, a second surface having a plurality of openings, and a third surface having a plurality of openings, said display board having at least one surface thereof adapted for being visible to an observer;

b. indicia associated with each of said plurality of openings, each indicium denoting a selected time period;

c. peg means for fitting within any of said plurality of openings for supporting said peg means against the pull of gravity, said peg means comprising a shaft portion dimensioned to be removably placed in any of said openings and an indicia bearing portion including a plurality of faces, each of said plurality of faces including a different indicium able to be visible to an observer without removal of said shaft portion of said peg means from an opening.

2. The device of claim 1 in which said first, second, and third surfaces lie in three separate planes substantially orthogonally oriented with respect to one another.

3. The device of claim 2 which additionally comprises means for mounting said device on a wall.

4. The device of claim 3 in which at least two faces of said plurality of faces each include an indicium of a selected sequence.

5. The device of claim 3 in which said first, second, and third surfaces lie in three separate planes substantially orthogonally oriented with respect to one another.

* * * * *